US007617549B2

(12) United States Patent
Pollock

(10) Patent No.: US 7,617,549 B2
(45) Date of Patent: Nov. 17, 2009

(54) AMBULANCE COT WITH A CENTRALLY LOCATED LOADING WHEEL PROVIDING IMPROVED LOWEST POSITION MANEUVERABILITY AND METHOD OF USE

(75) Inventor: Irvin D. Pollock, Wilmington, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 318 days.

(21) Appl. No.: 11/674,830

(22) Filed: Feb. 14, 2007

(65) Prior Publication Data

US 2008/0189860 A1 Aug. 14, 2008

(51) Int. Cl.
*A61G 1/02* (2006.01)

(52) U.S. Cl. ..... 5/86.1; 5/611; 5/620; 296/20

(58) Field of Classification Search ..... 5/611, 5/86.1, 620, 600; 296/20
See application file for complete search history.

(56) References Cited

U.S. PATENT DOCUMENTS

| | | | | |
|---|---|---|---|---|
| 1,110,838 | A | 9/1914 | Taylor | |
| 1,924,496 | A | 8/1933 | Herod | |
| 3,304,116 | A | 2/1967 | Stryker | |
| 4,164,355 | A | 8/1979 | Eaton et al. | |
| 4,579,381 | A | 4/1986 | Williams | |
| 4,584,989 | A | 4/1986 | Stith | |
| 4,767,148 | A * | 8/1988 | Ferneau et al. | 296/20 |
| 5,083,625 | A | 1/1992 | Bleicher | |
| 5,348,326 | A | 9/1994 | Fullenkamp et al. | |
| 6,401,278 | B1 | 6/2002 | Hayes et al. | |
| 6,505,359 | B2 | 1/2003 | Heimbrock et al. | |
| 6,526,611 | B2 * | 3/2003 | Flynn et al. | 5/611 |
| 6,728,982 | B2 | 5/2004 | Lemire et al. | |
| 7,131,151 | B2 * | 11/2006 | Ferneau et al. | 5/86.1 |
| 7,302,718 | B2 * | 12/2007 | Ferneau et al. | 5/86.1 |

FOREIGN PATENT DOCUMENTS

| | | |
|---|---|---|
| DE | 26 35 238 A1 | 3/1978 |
| DE | 26 51 039 A | 5/1978 |
| FR | 2 439 583 | 5/1980 |
| FR | 2 664 495 A1 | 9/2003 |

* cited by examiner

*Primary Examiner*—Alexander Grosz
(74) *Attorney, Agent, or Firm*—Dinsmore & Shohl LLP

(57) ABSTRACT

An ambulance cot comprising generally a variable height support frame which is positionable and maneuverable above a surface by adjustable legs having support wheels and a method of use are disclosed. The support frame has a first portion pivotally coupled to a second portion having loading wheels. With the cot in a lowest position, the loading wheel are configured to rotate about a single axis when engaging the surface and to be positioned above the surface when the second portion is placed in a raised position relative to the first portion. The cot further includes a swivel castor mounted to the first portion between the loading wheels and the support wheels. When the cot is in the lowest position, the swivel castor engages the surface and will rotate about two axes when the second portion is in the raised position and about the same axis as the loading wheels when the second portion is not in the raised position.

4 Claims, 4 Drawing Sheets

AMBULANCE COT WITH A CENTRALLY LOCATED LOADING WHEEL PROVIDING IMPROVED LOWEST POSITION MANEUVERABILITY AND METHOD OF USE

FIELD OF THE INVENTION

This invention relates to ambulance cots used by paramedics and other emergency vehicle operators to transport patients from a place of injury or illness to the emergency vehicle.

BACKGROUND OF THE INVENTION

Known ambulance cots presently used by paramedics and ambulance operators use loading wheels to help facilitate the loading and unloading of the cots into and out of the transport section of an ambulance or other emergency response vehicles. Such loading wheels are typically mounted at or near the front section of the cot and rotate about a single axis. This single axis of rotation provided by the loading wheels limits the maneuverability of the cot to a straight line, i.e., forward and back directions, as intended.

Ambulance cots of the type known as roll-in, multi-level cots have legs that swing rearward as the cot is loaded into the ambulance, which places the cot in its lowest position. Such cot are positionable conveniently in the lowest position even when not being loading into the ambulance, in order to permit loading of a patient onto the cot. However, while in the lowest position wherein such known cots are support on a support surface via wheels of the rearwardly swung legs and the loading wheels for stability, movement of such cots is limited to the forward and back directions due to the single axis of rotation of the loading wheels. Such limited range of motion with a roll-in cot in the lowest position is not desirably in all situation.

SUMMARY OF THE INVENTION

It is against the above background that the present invention provides a multi-level roll-in ambulance cot that has improved lowest position maneuverability. The present invention is particularly useful in those situations which require that the cot be maintained in the lowest position while transporting a patient from tight quarters to an ambulance or other emergency vehicle. In such situations, the invented cot provides easy maneuverability in tight quarters while supporting the patient.

The cot of the present invention comprising generally a variable height support frame which is positionable and maneuverable above a surface by adjustable legs having support wheels, the support frame having a first portion pivotally coupled to a second portion having loading wheels. With the cot in the lowest position, the loading wheel are configured to rotate about a single axis when engaging the surface and to be positioned above the surface when the second portion is placed in a raised position relative to the first portion. The cot further includes a swivel castor mounted between the loading wheels and the support wheels. When the cot is in the lowest position, the swivel castor engages the surface and will rotate about two axes when the second portion is in the raised position and about the same axis as the loading wheels when the second portion is not in the raised position.

These and other features and advantages of the present invention will be apparent from the following detailed description provided hereinafter with reference to the accompanying drawings.

DESCRIPTION OF THE DRAWINGS

The present invention is illustrated by way of example and not limitation in the accompanying figures, in which like references indicate similar elements, and in which.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiment(s) of the present invention.

DETAILED DESCRIPTION OF THE INVENTION

Figure 1:
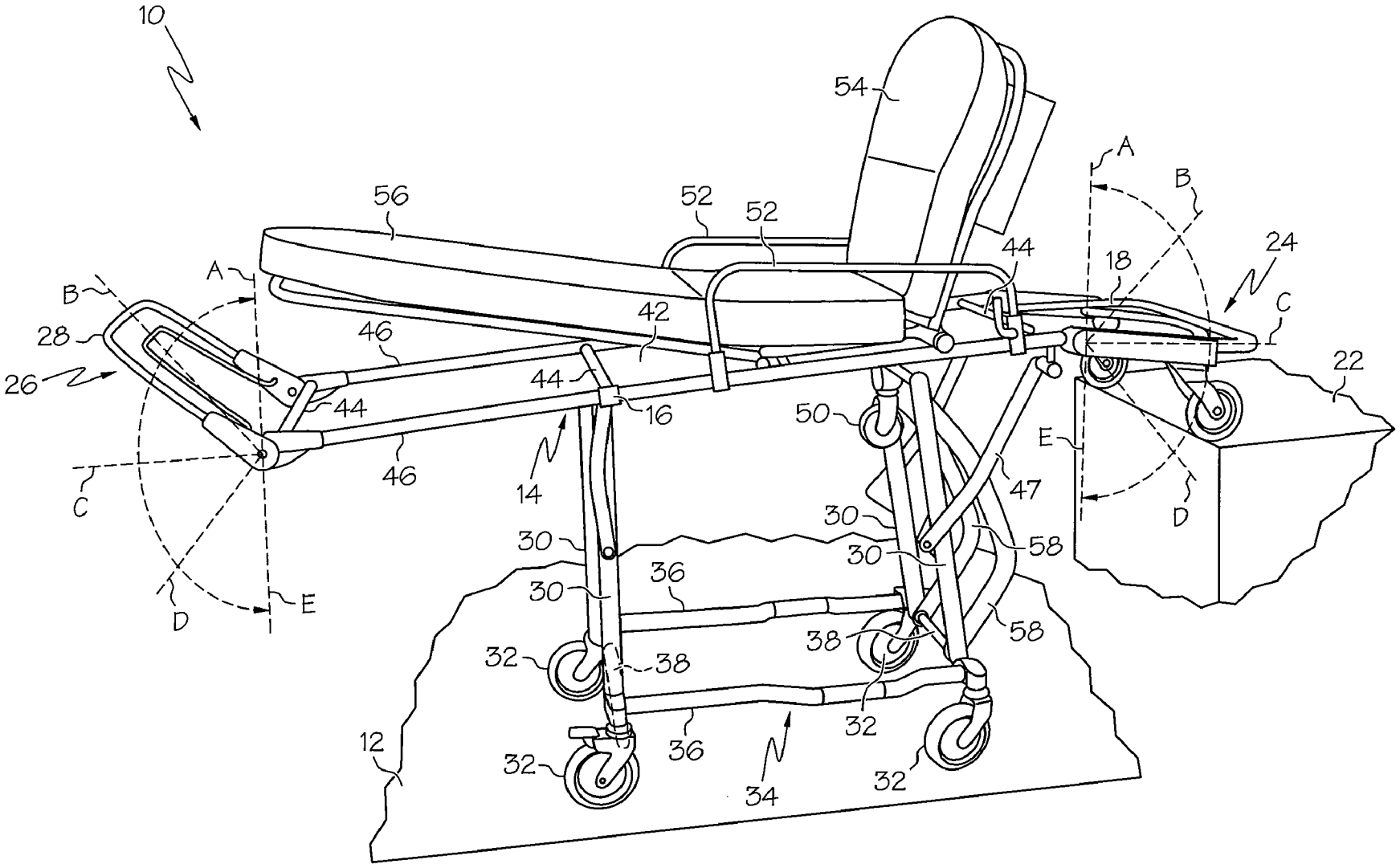
FIG. 1 is a side elevation view of the invented cot shown in a fully raised position.

Referring to FIG. 1, an ambulance cot generally indicated by symbol 10, is configured for movement about a support surface 12. In one embodiment, the ambulance cot 10 is of the type known as a roll-in, multi-level cot, and in other embodiments may be of any other cot type that uses loading wheels which limit the maneuverability of the cot to forward and back directions. As shown by FIG. 1, the cot 10 is depicted in a fully upright or elevated position. A fully lowered or lowest position of the cot 10 is depicted by FIG. 2.

In the illustrated embodiments, the cot 10 comprises a generally rectangular shaped support frame 14. The support frame 14 has a first portion 16 pivotally coupled to a second portion 18. The second portion 18 is provided with loading wheels 20 to help facilitate loading and unloading of the cot 10 onto an elevated support surface 22, such as for example, a transport deck of an emergency vehicle (e.g., an ambulance). The second portion 18 defines a forward or loading end 24 of the cot 10. The loading wheels 20 are mounted at or near the loading end 24 and rotate about a single axis, thus limiting the maneuverability of the cot 10 to a straight line, i.e., forward and back directions, as intended. At a rearward or trailing end 26 of the cot 10, a third portion 28 is also coupled pivotally to the first portion 16 of the support frame 14.

Figure 2:
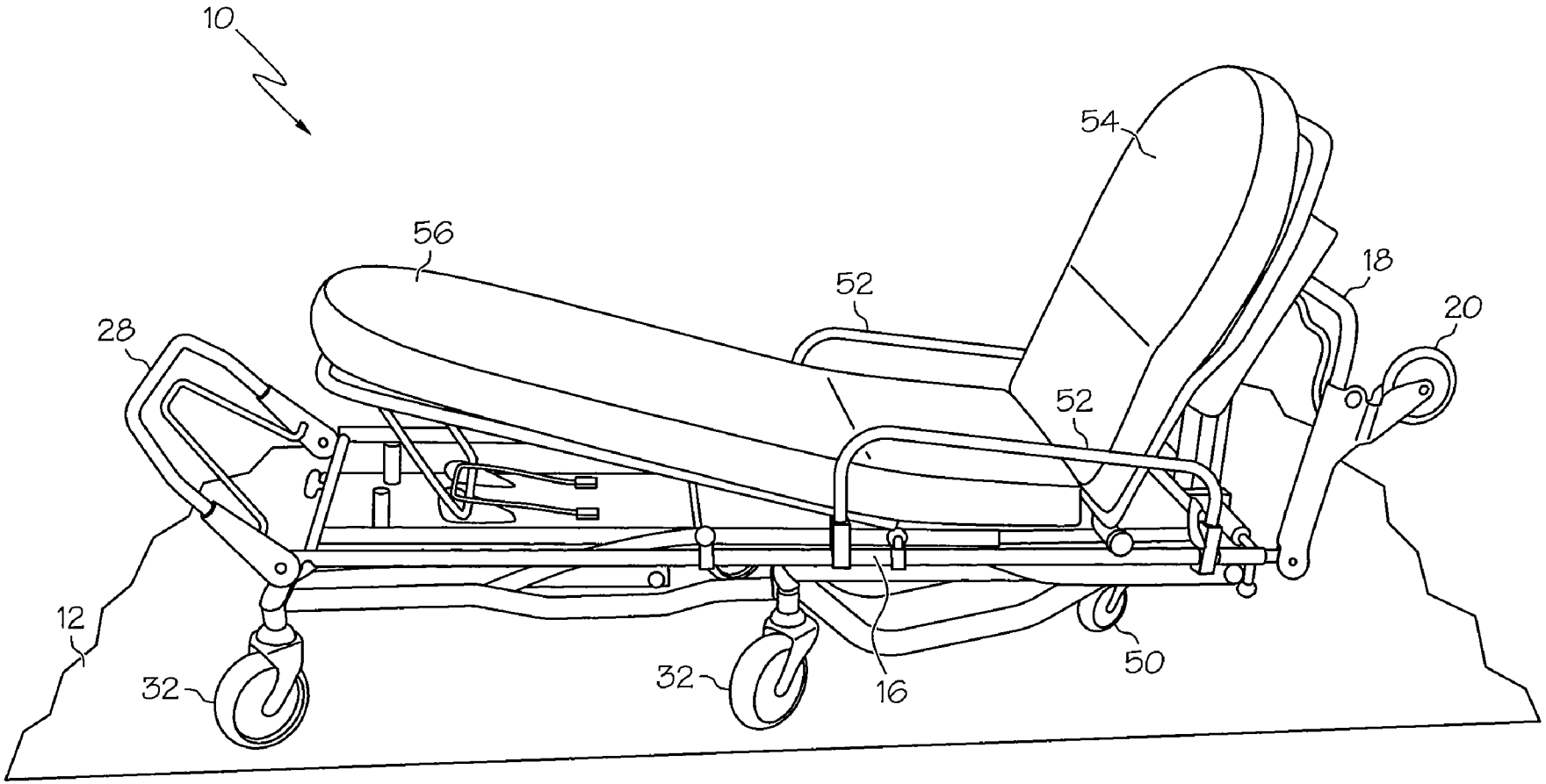
FIG. 2 is a side elevation view of the invented cot shown in a fully lowered position.

In one embodiment, the second portion 18 is configured to be positionable at least between an extended position relative to the first portion 16, such as illustrated by FIG. 1, and a raised position relative to the first portion 16 as shown by FIG. 2. In the raised position, the loading wheels 20 do not engage the support surface 12 when the cot 10 is in the lowest position. In another embodiment, the second portion 18 is configured to be positionable between a fully raised position A, upper middle position B, an extended position C, a lower middle position D, and a collapsed or lowered position E. In other embodiments, both the second and third portions 18 and 28 are similarly configured, and in still other embodiments either or both portions 18, 28 may be infinitely positionable between the fully raised position A and fully lowered position E.

In one embodiment, the second and third portions 18 and 28 are drop frames of the type disclosed by co-pending and co-owned U.S. patent application Ser. No. 11/340,165, the disclosure of which is herein fully incorporated by reference. In still another embodiment, either or both of the second and third portions 18 and 28 are further positionable in a lengthened position, such as disclosed by co-owned U.S. patent application Ser. No. 11/005,717, now U.S. Pat. No. 7,131,151, the disclosure of which is herein fully incorporated by reference.

As shown by FIG. 1, legs 30 are coupled pivotally to the cot 10 and configured to pivot to height adjust the support frame 14 relative to the support surface 12. Support wheels 32 are also provided to the cot 10. In the illustrated embodiment, the support wheels 32 are swivel castors which are mounted at corners of a generally rectangular base frame 34. The base frame 34 includes opposed longitudinal frame members 36 mounted to transverse members 38.

Figure 4:
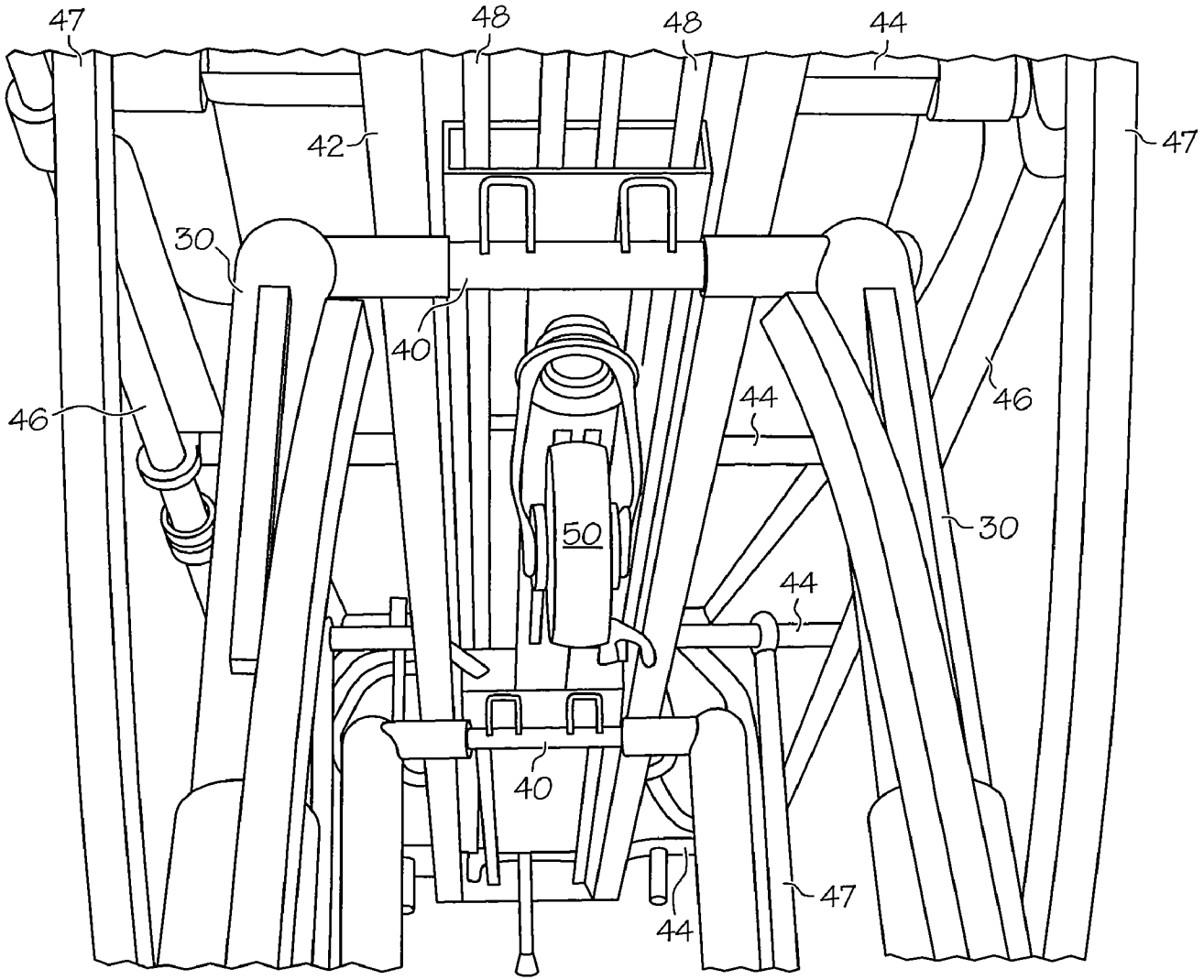
FIG. 4 is a bottom perspective view directed towards a trailing end of the invented cot and showing a centrally mounted swivel castor.

Pairs of the legs 30 are mounted pivotally at lower ends thereof to respective ones of the transverse members 38 as shown by FIG. 1. The upper ends of the pairs of legs 30 are mounted to a respective crosswise member 40 as best shown by FIG. 4. The crosswise members 40 are mounted pivotally to a central support member 42 of the support frame 14. Mounted to the central support member 42 are cross-frame members 44 of the support frame 12. The cross-frame members 44, at ends thereof, are mounted to and between opposed side frame members 46 of the support frame 12. Pairs of leg braces 47 at there upper ends are mounted pivotally to respective cross-frame members 44 and to a respective leg 30 at lower ends thereof.

Figure 3:
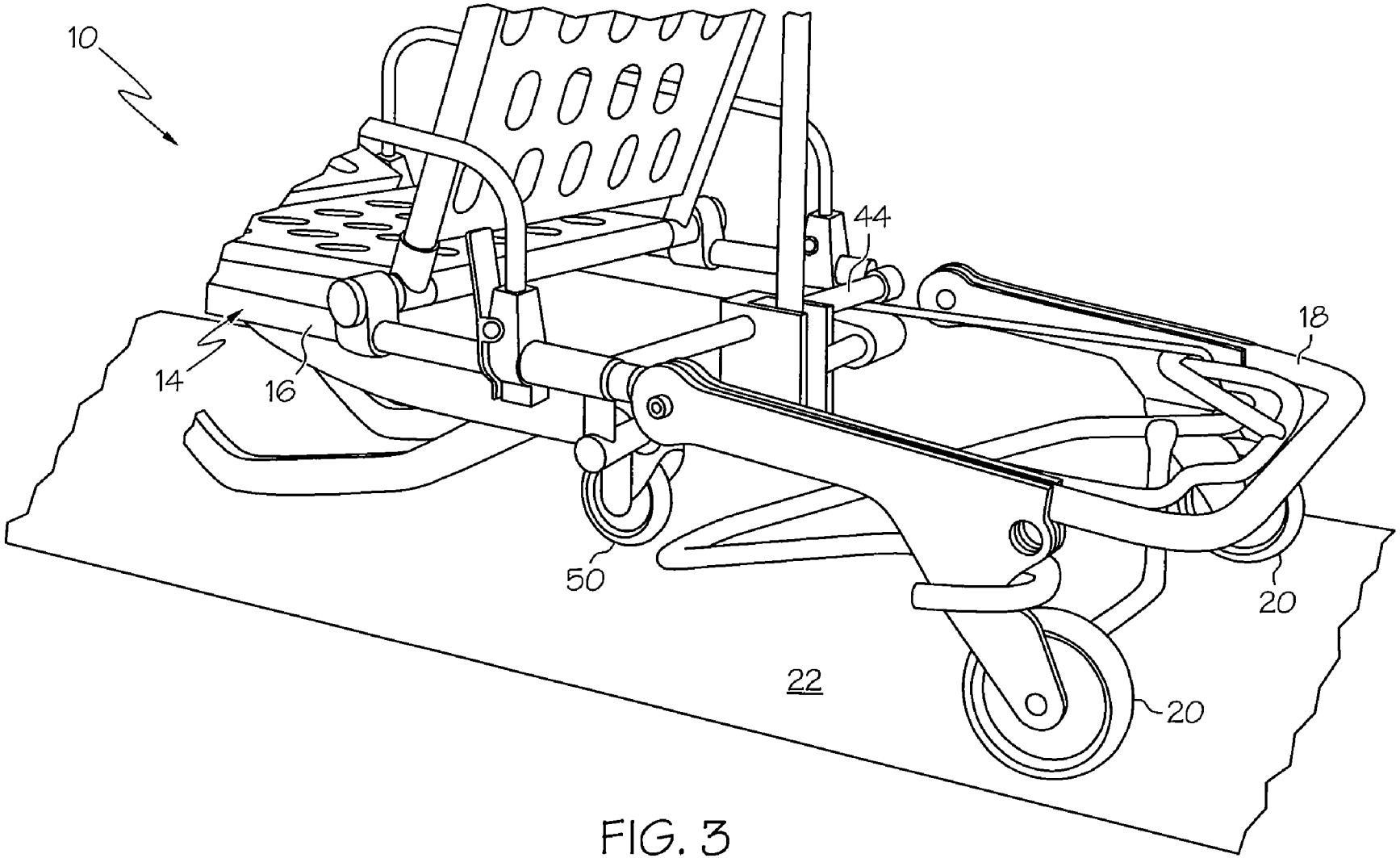
FIG. 3 is a side loading end view of the invented cot positioned securely on a support surface of an emergency vehicle.

With reference to FIG. 4, a hand actuated securing mechanism 48 of the cot 10 is configured to permit the legs 30 to swing rearward as the cot is loaded onto the elevated surface 22 which places the cot in its lowest position such as illustrated by FIG. 4. The hand actuated securing mechanism 48 is also configured to permit positioning of the cot in the lowest position even when not being loading into the ambulance, in order to permit loading of a patient onto the cot, such as shown by FIG. 2. It is to be appreciated that in the lowest position, the support wheels 32 are situated rearward of the loading end 24 of the cot 10, closer to the trailing end 26 than to the loading end 24. With the cot 10 in the lowest position and the second portion 18 in the extended position such as illustrated by FIGS. 1 and 3, it is further to be appreciated that the cot 10 is supported upon the support surface 12 via the loading wheels 20, the support wheels 32, and a centrally mounted swivel castor 50.

The swivel castor 50 is mounted to the central support member 40 of the cot 10 between the loading wheels 20 and the support wheels 32. In particular, the swivel castor 50 is mounted at a location that provides the cot 10 stability and support on the support surface 12, via the support wheels and the swivel castor, when the cot is in the lowest position with the loading wheels 20 are in the raised position, such as depicted by FIG. 2, unengaged from the support surface 12. In this manner, with the cot 10 supported in the lowest position via only the support wheels 32 and the centrally mounted swivel castor 50, the cot 10 is maneuverable about the support surface 12 (or any other surface) in forward, back, and side directions (i.e., 360°). Likewise, when the cot 10 is supported in the lowest position via the support wheels, the centrally mounted swivel castor 50, and the loading wheels 20, the cot 10 is limited to being maneuverable in the forward and back directions when the loading wheels engage the support surface (or any other surface).

It will be understood that the basic cot frame 10 may be provided with various adjustable features, such as folding side arms 52, a multiple-position backrest 54, and an adjustable leg section 56 for placing the patient in a shock position, which is illustrated by FIGS. 1 and 2. As these feature are conventional, no further discussion is provided. Other features also may be provided, such as bump guards 58 to the legs 30.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is therefore, claimed in any of its forms or modifications within the proper scope of the appended claims appropriately interpreted in accordance with the doctrine of equivalents. Any modification of the present invention that comes within the spirit and scope of the following claims should be considered part of the present invention.

What is claimed is:

1. An ambulance cot configured for movement about a support surface, said cot comprising:

a support frame having a first portion pivotally coupled to a second portion, said second portion having a pair of loading wheels, wherein said second portion is positionable in a raised position relative to said first portion such that said loading wheels do not engage the support surface when said cot is in a lowest position;

legs are pivotally coupled to said cot and configured to pivot to height adjust said support frame relative to the support surface;

support wheels connected to said legs; and a swivel castor mounted to said cot between said loading wheels and said support wheels, wherein said cot in said lowest position is maneuverable about said surface in forward, back, and side directions when said cot is supported on the support surface via said support wheels and said swivel castor and not said loading wheels, and limited to being maneuverable in said forward and back directions when said loading wheels engage the support surface.

2. A method of using a roll-in multi-level ambulance cot according to claim 1, said method comprising:

placing said cot in said lowest position;

placing said second portion in said raised position; and maneuvering said cot about the support surface in forward, back, and side directions, wherein said support frame is supported on the support surface via said support wheels and said swivel castor and not said loading wheels.

3. The method of claim 2 further comprising engaging said loading wheels with the support surface by removing said second portion from said raised position to limit maneuvering of said cot to said forward and back directions.

4. An ambulance cot configured for movement about a support surface, said cot comprising:

a height adjustable support frame having a first portion pivotally coupled to a second portion, said second portion having a pair of loading wheels, said loading wheels are configured to rotate about a single axis when engaging the support surface, wherein said second portion is positionable in a raised position relative to said first portion such that said loading wheels do not engage the support surface when said cot is in a lowest position;

legs pivotally connected to said first portion of said support frame, and configured to pivot away from said loading wheels when transitioning said support frame from an elevated position above the support surface to said lowest position, said legs having support wheels which engage the support surface; and a swivel castor mounted to said first portion between said loading wheels and said support wheels, wherein said swivel castor rotates about two axes when engaging said support surface and when said second portion is positioned in said raised position, and wherein said swivel castor rotates about the same axis as said loading wheels when engaging said support surface and when said second portion is not in said raised position.

* * * * *